US007484837B2

(12) United States Patent
Koga et al.

(10) Patent No.: US 7,484,837 B2
(45) Date of Patent: Feb. 3, 2009

(54) LIQUID SUPPLY UNIT AND INKJET RECORDING APPARATUS WITH LIQUID SUPPLY UNIT

(75) Inventors: Yuji Koga, Nagoya (JP); Takatoshi Takemoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 254 days.

(21) Appl. No.: 11/276,642

(22) Filed: Mar. 8, 2006

(65) Prior Publication Data

US 2006/0203047 A1 Sep. 14, 2006

(30) Foreign Application Priority Data

Mar. 9, 2005 (JP) ..... 2005-065476

(51) Int. Cl.
*B41J 2/175* (2006.01)

(52) U.S. Cl. ..... 347/85

(58) Field of Classification Search ..... 347/84, 347/85, 86, 87; 141/2, 18; 251/149, 149.8
See application file for complete search history.

(56) References Cited

U.S. PATENT DOCUMENTS 6,030,074 A * 2/2000 Barinaga ..... 347/85
6,243,115 B1 * 6/2001 Baker et al. ..... 347/85
6,290,343 B1 * 9/2001 Lewis et al. ..... 347/85
6,474,797 B2 * 11/2002 Kurata et al. ..... 347/85
6,612,689 B2 9/2003 Suenaga et al.
6,629,758 B2 * 10/2003 Okamoto et al. ..... 347/85
6,843,557 B2 1/2005 Matsumoto
6,905,197 B2 6/2005 Suenaga et al.

FOREIGN PATENT DOCUMENTS

JP 2002120380 A 4/2002

* cited by examiner

*Primary Examiner*—Anh T. N. Vo
(74) *Attorney, Agent, or Firm*—Baker Botts, LLP

(57) ABSTRACT

A liquid supply unit includes a main tank, a sub-tank, a pressure supply mechanism, an air communication hole, an air-permeable film and an excess pressure dispersion unit. The main tank stores liquid. The sub-tank is provided in a jet device, which ejects liquid droplets, and connected to the main tank. The pressure supply mechanism applies predetermined pressured to liquid in the main tank for supplying the liquid to the sub-tank. The air communication hole is provided on an upper surface of the sub-tank and communicates inside of the sub-tank with atmospheric air. The air-permeable film is provided for closing the air communication hole. The air-permeable film passes air, but not liquid. The excess pressure dispersion unit disperses excess pressure from the liquid supply unit when the liquid in the sub-tank becomes in contact with the air-permeable film and the pressure inside the sub-tank becomes higher than the predetermined pressure.

8 Claims, 6 Drawing Sheets

LIQUID SUPPLY UNIT AND INKJET RECORDING APPARATUS WITH LIQUID SUPPLY UNIT

CROSS-REFERENCE TO RELATED APPLICATIONS

This application claims the benefit of Japanese Patent Application No. 2005-65476 filed Mar. 9, 2005 in the Japan Patent Office, the disclosure of which is incorporated herein by reference.

BACKGROUND

This invention relates to a liquid supply unit having a pressure supply mechanism that supplies liquid inside of a main tank to a sub-tank incorporated in a liquid droplet jet device. This invention also relates to an inkjet recording apparatus having the liquid supply unit.

Conventionally, various suggestions have been made with regard to liquid supply to a sub-tank for the purpose of supplying liquid to a jet device which ejects liquid droplets onto a recording medium based on image information.

For example, a conventional inkjet recording apparatus with a liquid supply unit is provided with a sub-tank and an ink supply unit. The sub-tank is disposed on a carriage that carries a recording head for scanning. The ink supply unit is disposed separately from the sub-tank. When the ink supply unit becomes in contact with the sub-tank, pressure inside of the sub-tank is decompressed by drawing air inside of the sub-tank with the aid of a suction pump provided in the ink supply unit. As a result, ink is supplied to the sub-tank. The sub-tank is provided with a detection sensor for detecting remaining ink level.

The amount of ink inside of the sub-tank should be preferably maintained at a specific amount at all times. If the amount of ink inside of the sub-tank is small, ink runs out while ink supply to the recording head is performed. Thus, there will be shortage of ink. On the other hand, if the sub-tank is full with ink, the ink might overflow from the sub-tank due to vibration when the inkjet recording apparatus is moved. Surrounding components around the sub-tank might be tainted with ink. In the light of this point, the amount of ink inside of the sub-tank needs to be controlled so as to be maintained consistently at a predetermined amount.

However, the conventional ink supply unit described above is provided with a sensor that detects the amount of ink inside of the sub-tank. Disposition of this kind of sensor requires a space in the interior of the sub-tank for installing the sensor, wiring for the sensor, and a control system for controlling the ink supply unit based on a detection signal. Consequently, the structure of the inkjet recording apparatus becomes complicated. As the number of components increases, not only the cost for the sensor and other components associated with the sensor is needed, but also more steps for installation process are required. Therefore, the manufacturing cost for the inkjet recording apparatus increases.

It would be desirable that, with inexpensive cost and via simple structure, a liquid supply unit can supply liquid to a sub-tank of an inkjet recording apparatus in a manner so that the amount of the liquid in the sub-tank can be maintained at a specific amount.

SUMMARY

In one aspect of the present invention, a liquid supply unit includes a main tank, a sub-tank, a pressure supply mechanism, an air communication hole, an air-permeable film and an excess pressure dispersion unit. The main tank stores liquid. The sub-tank is provided in a jet device, which ejects liquid droplets, and connected to the main tank. The pressure supply mechanism applies predetermined pressured to liquid reserved in the main tank so as to supply the liquid inside of the main tank to the sub-tank. The air communication hole is provided on an upper surface of the sub-tank, and communicates inside of the sub-tank with atmospheric air. The air-permeable film is provided so as to close the air communication hole. The air-permeable film passes air but does not pass liquid. The excess pressure dispersion unit disperses excess pressure from the liquid supply unit when the liquid inside of the sub-tank becomes in contact with the air-permeable film and the pressure inside the sub-tank becomes higher than the predetermined pressure.

In this configuration, as liquid is supplied from the main tank to the sub-tank by the pressure supply mechanism, air inside of the sub-tank is discharged outside of the sub-tank through the air-permeable film. When the liquid surface inside of the sub-tank goes up and becomes in contact with the air-permeable film, the air-permeable film is blocked by the liquid surface. Air inside of the sub-tank is no longer discharged outside of the sub-tank. The pressure inside of the sub-tank increases. When the pressure inside of the sub-tank becomes equal to or higher than the predetermined pressure, conveyance of liquid from the main tank to the sub-tank is stopped due to the excess pressure dispersion unit.

The amount of liquid inside of the sub-tank decreases when the liquid inside of the sub-tank is supplied to a recording head and used for image formation on a recording medium. After image formation, the pressure supply mechanism is operated at a suitable timing so as to once again convey liquid from the main tank to the sub-tank. As a result, the amount of liquid inside of the sub-tank can be maintained at a specific amount. Therefore, a specific amount of liquid can be constantly supplied to the recording head. Since the air communication hole inside of the sub-tank is disposed as closely as possible to the upper surface of the sub-tank, the sub-tank can be filled with liquid up to almost full capacity of the sub-tank.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

First Embodiment

[Overall Structure of Inkjet Recording Apparatus]

The present embodiment is one example wherein the present invention is applied to a multifunction apparatus which serves as a printer, a copier, a scanner, a facsimile, a telephone and the like.

Figure 1:
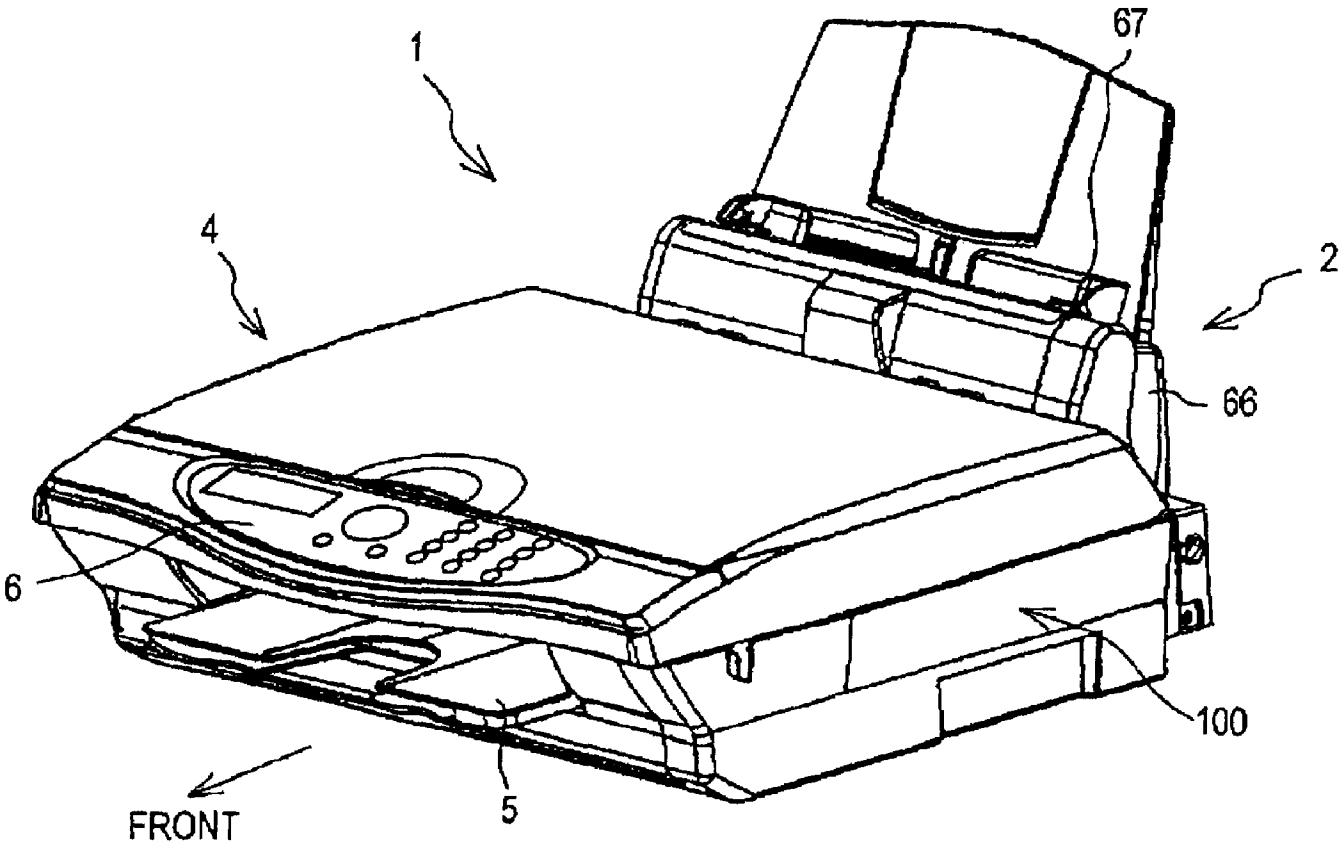
FIG. 1 is a perspective view showing a multifunction apparatus that works as a printer, a copier, a scanner, a facsimile, and a telephone.

As shown in FIG. 1, a multifunction apparatus 1 according to the present embodiment comprises a paper supply unit 2, an inkjet printer 100 and a reading unit 4. The paper supply unit 2 is provided at the rear end of the multifunction apparatus 1. The inkjet printer 100 is provided in front of the lower portion of the paper supply unit 2. The reading unit 4 is provided on top of the printer 100 for reading an image as a copier, a facsimile or a scanner. The multifunction apparatus 1 is further provided with a discharge tray 5 in front of the printer 100, and an operation panel 6 at the front end of the upper surface of the reading unit 4.

The paper supply unit 2 comprises an inclined wall portion 66 that supports paper in an inclined state, and an extendable paper guide plate 67 that is detachably attached to the inclined wall portion 66 so as to guide paper. A plurality of sheets of paper can be stored in the paper supply unit 2. The inclined wall portion 66 incorporates a paper supply motor 65 (not shown in FIG. 1) and a paper feed roller (not shown). In the paper supply unit 2, the paper feed roller, which is rotated by the driving force of the paper supply motor 65, conveys paper toward the printer 100.

[Structure of Printer 100]

Figure 2:
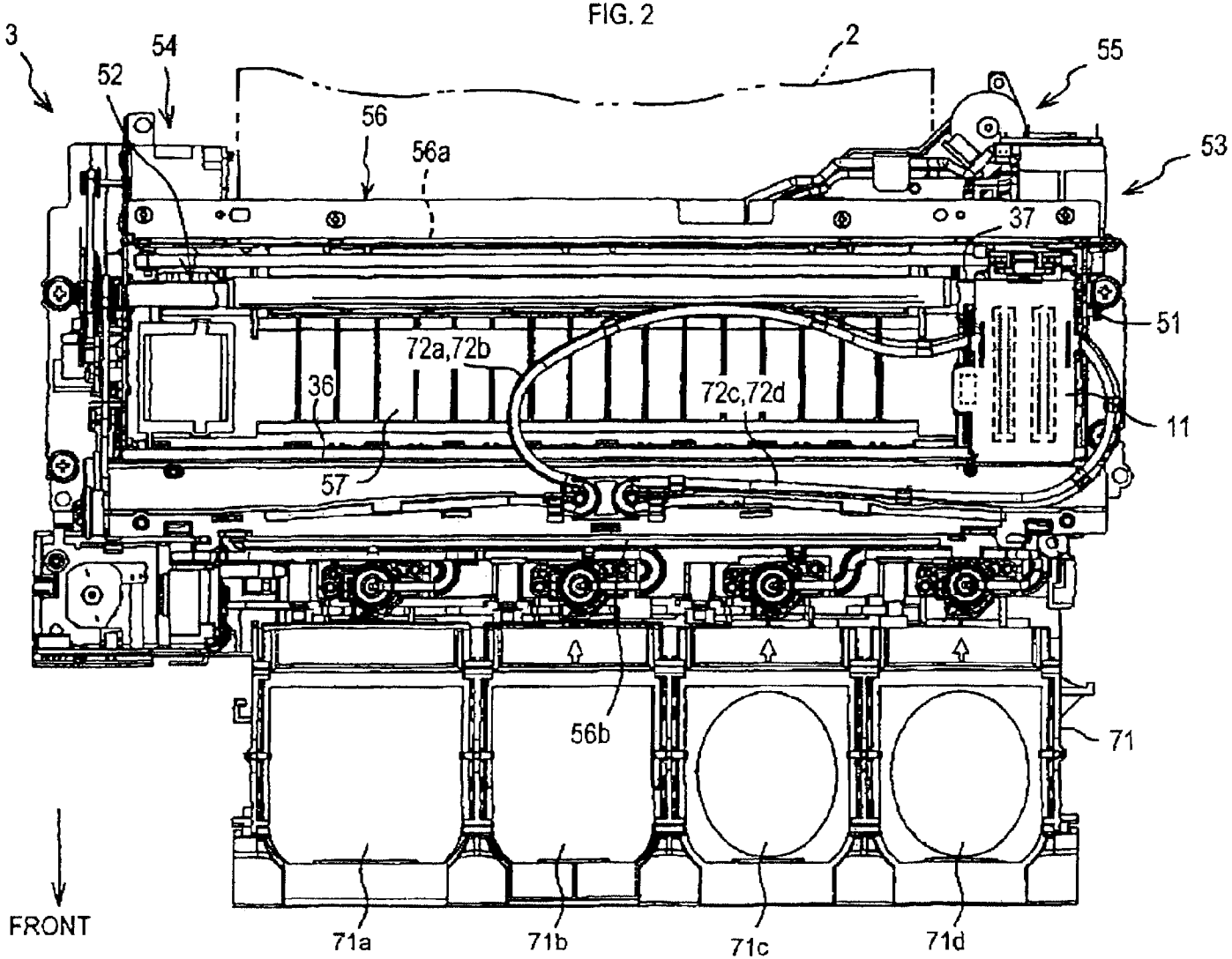
FIG. 2 is a plan view showing an internal structure of the printer included in the multifunction apparatus.

As shown in FIG. 2, the printer 100 comprises a recording head 11, a carriage 51, a guide mechanism 52, a carriage moving mechanism 53, a paper conveyance mechanism 54 and a maintenance mechanism 55. The carriage 51 carries the recording head 11 thereon. The guide mechanism 52 supports the carriage 51 so that the carriage 51 can move reciprocally in the left-to-right direction as a scanning direction. The carriage moving mechanism 53 moves the carriage 51 in the left-to-right direction. The paper conveyance mechanism 54 conveys paper supplied by the paper supply unit 2. The maintenance mechanism 55 is provided, for maintaining the recording head 11.

The printer 100 is provided with a frame 56 in a rectangular parallelepiped shape that is large in the left-to-right direction and small in the up-and-down direction. The guide mechanism 52, the carriage moving mechanism 53, the paper conveyance mechanism 54 and the maintenance mechanism 55 are attached to the frame 56. Furthermore, the recording head 11 and the carriage 51 are disposed inside of the frame 56 so as to be movable in the left-to-right direction.

The frame 56 includes a rear plate 56*a* and a front plate 56*b*. A paper introducing opening and a paper discharging opening (not shown) are respectively formed in the rear plate 56*a* and the front plate 56*b*. Paper supplied by the paper supply unit 2 is introduced into the frame 56 via the paper introducing opening, conveyed to the front of the frame 56 by the paper conveyance mechanism 54, and discharged through the paper discharging opening onto the discharge tray 5 (see FIG. 1) located on the front of the multifunction apparatus 1. A black platen 57, having a plurality of ribs, is mounted on the bottom surface of the frame 56. The recording head 11 performs recording (image forming) on paper inside of the frame 56 as the paper moves over the black platen 57.

A cartridge holder 70 is provided in front of the frame 56. The cartridge holder 70 includes ink cartridges 71*a*-71*d*, one for each of the four colors (black, cyan, yellow and magenta) of ink. The ink cartridges 71*a*-71*d* are connected to the recording head 11 via four flexible ink tubes 72*a*-72*d* that pass through the frame 56. Each of the four colors of inks is supplied to the recording head 11 when pressure is applied by a pressure pump (not shown). It is to be noted that the ink cartridge 71*a*-71*d* correspond with a main tank 18 described hereinafter.

The guide mechanism 52 has a guide shaft 37 and a guide rail 36. The guide shaft 37 extends in the left-to-right direction in the rear part of the frame 56. The guide rail 36 extends in the left-to-right direction in the front part of the frame 56. The rear end of the carriage 51 is fitted over the guide shaft 37 so as to be capable of sliding along the guide shaft 37, while the front end of the carriage 51 is engaged with the guide rail 36 and is capable of sliding along the guide rail 36.

[Structure of Ink Supply Unit 50]

Figure 3:
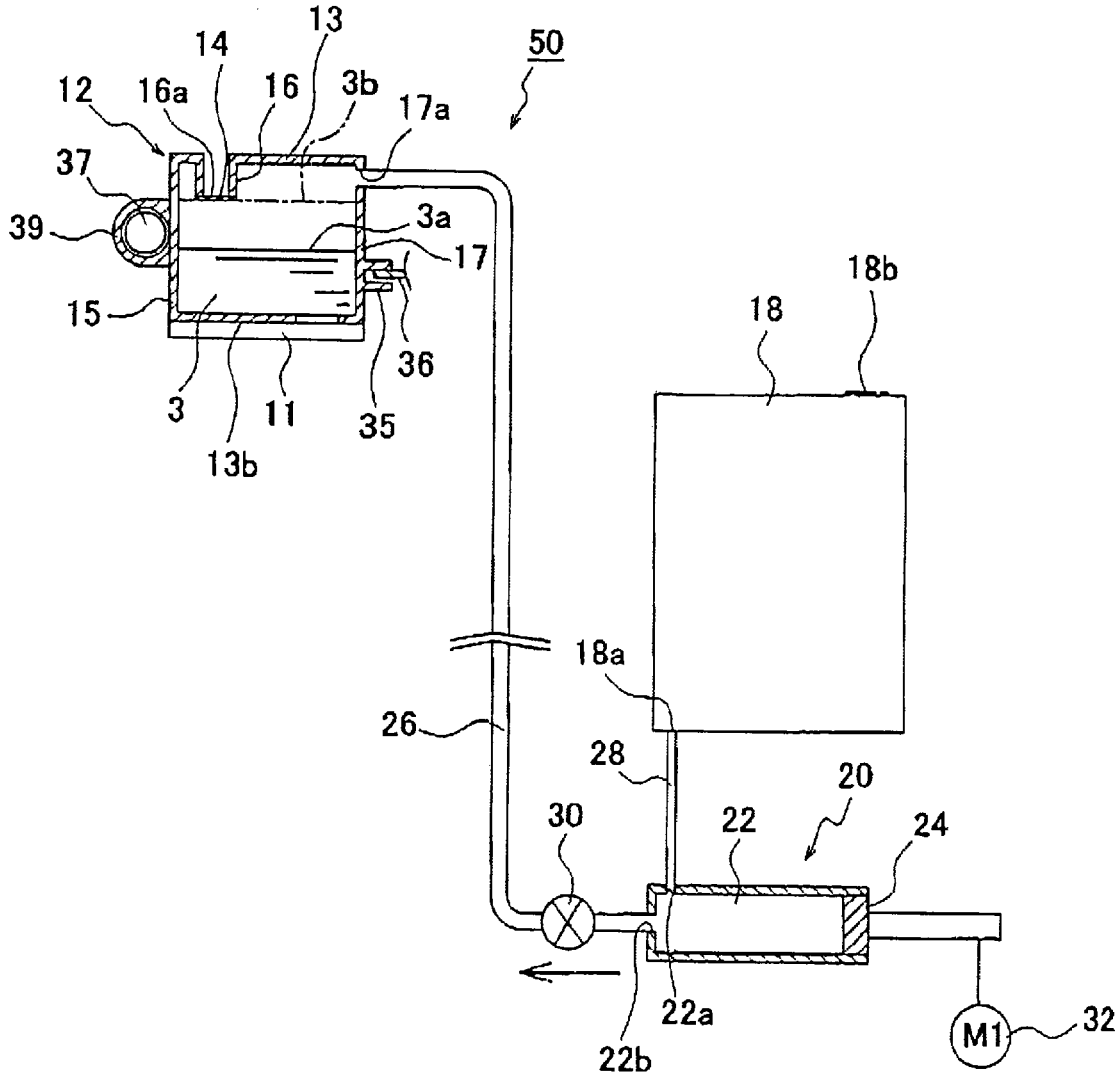
FIG. 3 is a partial cross sectional view showing a structure of an ink supply unit according to a first embodiment of the present invention.

Referring now to FIG. 3, an ink supply unit 50 includes a sub-tank 12, the aforementioned main tank 18, a piston cylinder device 20, and a piston drive motor 32.

The sub-tank 12 is a container which is in a rectangular parallelepiped shape and stores ink so as to supply the ink to the recording head 11. A top board 13 of the sub-tank 12 is provided with a cylindrical air communication hole 16 projecting downward. An opening 16*a* on the bottom end of the air communication hole 16 is closed with an air-permeable film 14. The air-permeable film 14 allows passage of air but does not allow passage of other materials except for air, such as ink or solid objects. The sub-tank 12 is sealed off from outside air except through the air communication hole 16 and a hole 17*a* on a side wall 17 of the sub-tank 12 which will be explained below.

A bottom board 13*b* of the sub-tank 12 is in contact with the top portion of the recording head 11. The side wall 17 is provided with the aforementioned hole 17*a*. One end of a first pipe 26, which connects the sub-tank 12 and the piston cylinder device 20 to be described later, is connected to the sub-tank 12 through the hole 17*a*.

The side wall 17 of the sub-tank 12 is furthermore provided with a guide rail receiver 35. The guide rail receiver 35 is constituted with two flat plates with ribs orthogonally extending from the side wall 17 in the horizontal direction. The two flat plates with ribs are disposed with some space therebetween in the up-and-down direction. The guide rail 36 is fitted into the space. The guide rail 36 is a flat plate fixed in the front portion inside the frame 56. The guide rail 36 guides the movement of the sub-tank 12 carried by the carriage 51 in the lateral direction (in the direction perpendicular to the sheet surface of FIG. 3).

A side wall 15 of the sub-tank 12, opposing the side wall 17, is provided with a guide shaft attachment portion 39. The guide shaft 37 is inserted through the guide shaft attachment portion 39. The guide shaft 37 is made of a linear metal rod having a circular cross section. As well as the guide rail 36, the guide shaft 37 guides the sub-tank 12 carried by the carriage 51 in the left-to-right direction of the printer 100 (in the direction perpendicular to the sheet surface of FIG. 3). Both end of the guide shaft 37 are fixed to side plates of the frame 56.

The main tank 18 is disposed in the printer 100 at a different location from the sub-tank 12. The main tank 18 stores ink that is supplied to the sub-tank 12. As well as the sub-tank 12, the main tank 18 is constituted in a rectangular parallelepiped shape. The top surface of the main tank 18 is provided with an air communication hole 18*b*. The bottom surface of the main tank 18 is provided with a hole 18*a*. The main tank 18 is connected to a second pipe 28 via the hole 18*a*. The second pipe 28 is connected to the cylinder 22 of the piston cylinder device 20.

The piston cylinder device 20 is disposed between the sub-tank 12 and the main tank 18. The piston cylinder device 20 includes the cylinder 22, which is in a cylindrical shape, and a columnar piston 24. The cylinder 22 temporarily reserves ink from the main tank 18. When sliding movement of the piston 24 is made inside of the cylinder 22, ink inside of the cylinder 22 is pressed and conveyed to the sub-tank 12. The piston 24 enters the cylinder 22 from one end of the cylinder 22. Two holes 22*a* and 22*b* are provided on another end of the cylinder 22. One end of the second pipe 28 is connected to the cylinder 22 via the hole 22*a*. One end of the first pipe 26 is connected to the cylinder 22 via the hole 22*b*. Therefore, the first pipe 26 connects the cylinder 22 and the sub-tank 12.

The inner diameter of the second pipe 28 is formed smaller than the inner diameter of the first pipe 26. That is, the flow resistance of the second pipe 28 is larger than the flow resistance of the first pipe 26.

The piston 24 is driven by the piston drive motor 32. When the piston 24 is driven toward the rear side of the printer 100 (toward the right direction in FIG. 3), ink 3 is supplied in the cylinder 24 from the main tank 18 through the second pipe 28 and temporarily reserved therein. When the piton 24 is driven toward the front side of the printer 100 (toward the left direction in FIG. 3), the ink 3 inside of the cylinder 22 is pressed by the piston 24 and ejected outside of the cylinder 22 from the holes 22*a* and 22*b*.

Since the flow resistance of the second pipe 28 is larger than the flow resistance of the first pipe 26 as described above, the ink 3 pressed by the piston 24 flows more easily toward the first pipe 26 than toward the second pipe 28.

Thus, when the pressure inside of the sub-tank 12 does not exceed predetermined pressure, the ink 3 pressed by the piston 24 flows more easily toward the first pipe 26 than toward the second pipe 28, and therefore, is supplied into the sub-tank 12. However, when the pressure inside of the sub-tank 12 reaches the predetermined pressure or becomes higher, the ink 3 pressed by the piton 24 does not flow into the first pipe 26 but flows into the second pipe 28. Consequently, supply of the ink 3 from the main tank 18 to the sub-tank 12 is stopped.

A check valve 30 is provided on the first pipe 26. The check valve 30 allows passage of the ink 3, pressed by the piston 24, from the cylinder 22 toward the sub-tank 12. However, the check valve 30 does not allow the reverse flow of ink 3 toward the cylinder 22. The direction of the flow of the ink 3 that passes through the check valve 30 is shown with an arrow in FIG. 3.

[Operation of Ink Supply Unit 50]

Referring to FIG. 3, when a user turns on the power of the printer 100, the piston drive motor 32 is started up. The piston 24 of the piston cylinder device 20 is moved toward the rear side of the printer 100 (toward the right direction in FIG. 3). Subsequently, the ink 3 contained in the main tank 18 is conveyed into the cylinder 22 from the hole 18*a* on the bottom surface of the main tank 18 through the second pipe 28 and temporarily reserved therein.

Then, the piston 24 is moved toward the front side of the printer 100 (toward the left direction in FIG. 3). The ink 3 reserved inside of the cylinder 22 is pressed by the piston 24 toward the second pipe 28 and the first pipe 26. Since the diameter of the second pipe 28 is smaller than the diameter of the first pipe 26, as described above, that is, the flow resistance of the second pipe 28 is larger than the flow resistance of the first pipe 26, the ink 3 pressed by the piston 24 is therefore conveyed into the first pipe 26 instead of being conveyed into the second pipe 28.

The check valve 30 provided on the first pipe 26 merely allows the passage of ink 3 from the cylinder 22 toward the sub-tank 12, as shown in FIG. 3. The ink 3 pressed by the piston 24 is conveyed through the first pipe 26 into the sub-tank 12 from the hole 17*a* provided on the side wall 17 of the sub-tank 12.

As the ink 3, pressed by the piston 24, is conveyed through the first pipe 26 into the sub-tank 12, the air inside of the sub-tank 12 is discharged outside of the sub-tank 12 from the air communication hole 16 of the sub-tank 12 through the air-permeable film 14.

Because of the operation of the check valve 30, when once ink 3 is supplied into the sub-tank 12, the ink is not conveyed back to the cylinder 22 irrespective of the rearward movement of the piston 24. Thus, when the piston 24 is brought to the rearward of the cylinder 22, the cylinder 22 is again filled with ink 3 supplied from the main tank 18. Subsequently, when the piston 24 is moved forward again, the ink 3 inside of the cylinder 22 is, in the same manner as before, pressed and supplied to the sub-tank 12 through the check valve 30 and the first pipe 26.

As described above, when the ink 3 reserved in the main tank 18 is conveyed into the sub-tank 12 by the piston cylinder device 20, ink surface 3*a* inside of the sub-tank 12 goes up. Air inside of the sub-tank 12 is discharged outside of the sub-tank 12 through the air-permeable film 14.

When the ink surface 3*a* becomes in contact with the air-permeable film 14, the ink 3 blocks fine holes of the air-permeable film 14. Consequently, discharge of the air inside of the sub-tank 12 to the outside through the air-permeable film 14 is stopped.

Then, the pressure inside of the sub-tank 12 goes up. When the pressure inside of the sub-tank 12 exceeds the predetermined pressure, supply of the ink 3, pressed by the piston 24, from the cylinder 22 into the first pipe 26 is stopped. The ink 3 is moved toward the main tank 18 through the second pipe 28.

In this manner, the pressure inside of the sub-tank 12 does not go up beyond the predetermined pressure. Thus, pressure higher than the predetermined pressure is not applied to the air-permeable film 14. Moreover, if the predetermined pressure is set equal to or smaller than the strength of meniscus formed on the nozzle end of the recording head 11, breakage of meniscus can be prevented.

Since the ink 3 supplied to the sub-tank 12 is pressed by the piston 24 and receives positive pressure, air is not drawn inside of the recording head 11 from the nozzle end even when meniscus is broken.

When the ink 3 inside of the sub-tank 12 is supplied to the recording head 11, the ink 3 is used for image formation onto a recording medium. Due to, for example, image formation being performed on several sheets of paper, when the amount of ink inside of the sub-tank 12 decreases, the piston cylinder device 20 is operated at a suitable timing. The ink 3 inside of the cylinder 22 is once again pressed by the piston 24 and conveyed to the sub-tank 12 through the first pipe 26.

Therefore, the amount of the ink 3 inside of the sub-tank 12 can be maintained at a specific amount. Moreover, a specific amount of the ink 3 can be supplied to the recording head 11.

If the air-permeable film 14 that closes the air communication hole 16 inside of the sub-tank 12 is disposed as closely as possible to the top board 13, the ink 3 can be supplied into the sub-tank 12 up to almost full capacity of the sub-tank 12.

Second Embodiment

[Structure of Ink Supply Unit 60]

Figure 4A:
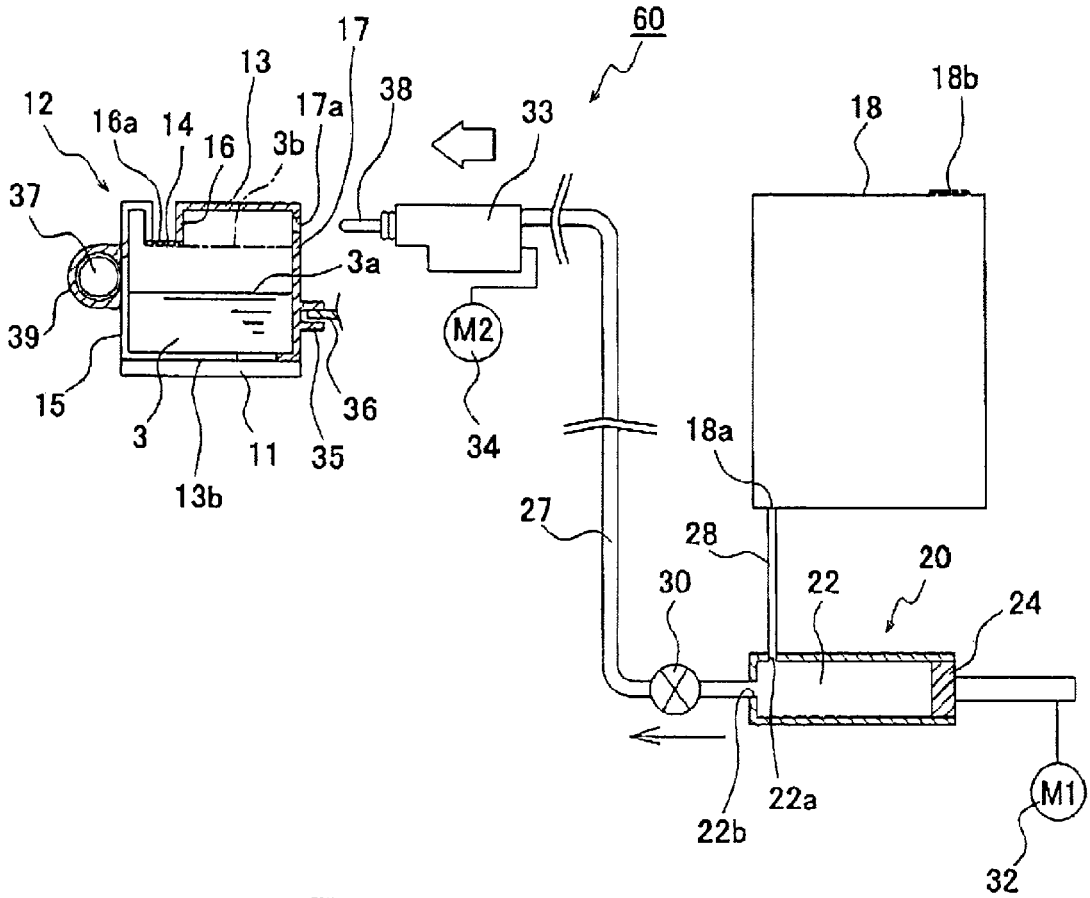
FIGS. 4A and 4B are partial cross sectional views showing structures of an ink supply unit according to a second embodiment.

Referring now to FIGS. 4A and B, an ink supply unit 60 of the present embodiment includes the sub-tank 12, main tank 18, the piston cylinder device 20, a first pipe 27, and a connector 33. The sub-tank 12, the main tank 18, the piston cylinder device 20 are the same components of the ink supply unit 50 in the first embodiment, and, therefore, not repeatedly described here.

The following merely explains the difference of the ink supply unit 60 of the present embodiment from the ink supply unit 50 of the first embodiment. The difference is that the first pipe 27 connecting the piston cylinder device 20 and the sub-tank 12 is formed to be attachable/detachable with respect to the sub-tank 12.

The first pipe 27 shown in FIG. 4A is provided with a connector 33 in the side of the sub-tank 12. A leading portion 38 is formed on one end of the connector 33 in the side of the sub-tank 12. The leading portion 38 is formed in a cylindrical shape and can be inserted into the hole 17*a* formed on the side wall 17 of the sub-tank 12.

In a side view of the sub-tank 12, the hole 17*a* is disposed higher than the air-permeable film 14. When the leading portion 38 is disconnected from the hole 17*a*, the ink 3 inside of the sub-tank 12 does not spill outside of the sub-tank 12 through the hole 17*a*. Therefore, a check valve does not need to be provided in order to prevent the ink 3 from leaking outside of the sub-tank 12 from the hole 17*a*.

A pipe drive motor 34 is connected to the connector 33. The pipe drive motor 34 moves the connector 33 and the first pipe 27 in the front-and-rear direction of the printer 100 (in the left-to-right direction in FIG. 4A). The other end of the first pipe 27 in the side of the piston cylinder device 20 is configured in the same manner as in the first embodiment, and, therefore, not described here.

[Operation of Ink Supply Unit 60]

Figure 4B:
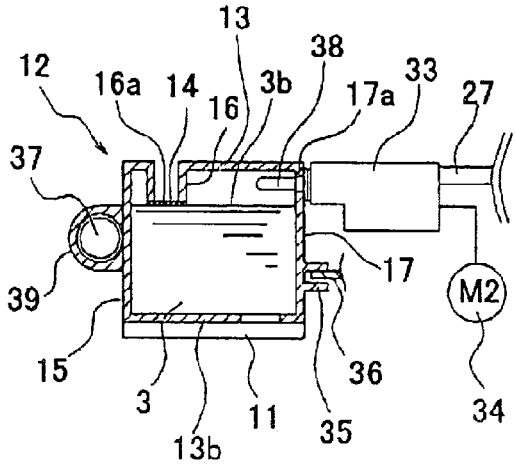

When the power of the printer 100 is turned on by a user, firstly, the sub-tank 12 is moved by the carriage 51 to an ink supply position (not shown). Then, the pipe drive motor 34, shown in FIG. 4A, is driven. As shown in FIG. 4B, the connector 33 of the first pipe 27 is moved to the front side of the printer 100 (in the left direction in FIG. 4B) by the pipe drive motor 34. The leading portion 38 is inserted into the hole 17*a* provided on the side wall 17 of the sub-tank 12.

Consequently, the piston drive motor 32 is driven while the leading portion 38 is inserted into the hole 17*a*. The ink 3 is conveyed into the sub-tank 12 in the same manner as in the first embodiment. When an ink surface 3*b* becomes in contact with the air-permeable film 14 and the supply of the ink 3 from the main tank 18 to the sub-tank 12 is stopped, the connector 33 of the first pipe 27 is moved by the pipe drive motor 34 to the rear side of the printer 100 (in the right direction in FIG. 4A). The leading portion 38 is removed from the hole 17*a* provided on the side wall 17 of the sub-tank 12. Since the hole 17*a* is disposed higher than the air-permeable film 14, the ink 3 does not spill from the hole 17*a*.

The ink 3 inside of the sub-tank 12 is supplied to the recording head 11 and used for image formation onto a recording medium. When, for example, the ink 3 is used for image formation onto several sheets of paper, and the amount of the ink 3 inside of the sub-tank 12 decreases, the piston cylinder device 20 is operated at a suitable timing. As shown in FIG. 4B, the connector 33 of the first pipe 27 is moved by the pipe drive motor 34 to the front side of the printer 100 (in the left direction in FIG. 4B). The leading portion 38 is inserted into the hole 17*a* provided on the side wall 17 of the sub-tank 12. Then, the piston cylinder device 20 is furthermore operated so that the ink 3 inside of the cylinder is once again pressed by the piston 24 and conveyed to the sub-tank 12 through the first pipe 27.

Due to the above-described operation, the amount of the ink 3 inside of the sub-tank 12 in the ink supply unit 60 can be maintained at a specific amount as well as in the ink supply unit 50 of the first embodiment. In addition, the first pipe 27 does not need to move in the left-to-right direction of the printer 100 when the recording head 11 including the sub-tank 12 is moved with the carriage 51 in the left-to-right direction of the printer 100. Therefore, the lifetime of the first pipe 27 can be enhanced.

The ink supply unit 60 shown in FIGS. 4A and 4B in accordance with the second embodiment is configured in a manner so that the connector 33 of the first pipe 27 becomes in contact with the sub-tank 12 from the orthogonal direction with respect to the moving direction of the sub-tank 12 (a direction perpendicular to the sheet surface of FIGS. 4A and 4B), and the leading portion 38 is inserted into the hole 17*a* of the sub-tank 12. Alternatively, the connector 33 of the first pipe 27 can be in contact with the sub-tank 12 from the same direction as the moving direction of the sub-tank 12 (in a direction perpendicular to the sheet surface of FIGS. 4A and 4B). The leading portion 38 can be inserted into the hole 17*a* which is, in this case, provided on a side wall of the sub-tank 12 facing the moving direction of the sub-tank 12. In this configuration, the pipe drive motor 34 that drives the first pipe 27 is not needed.

Third Embodiment

[Structure of Ink Supply Unit 70]

Figure 5:
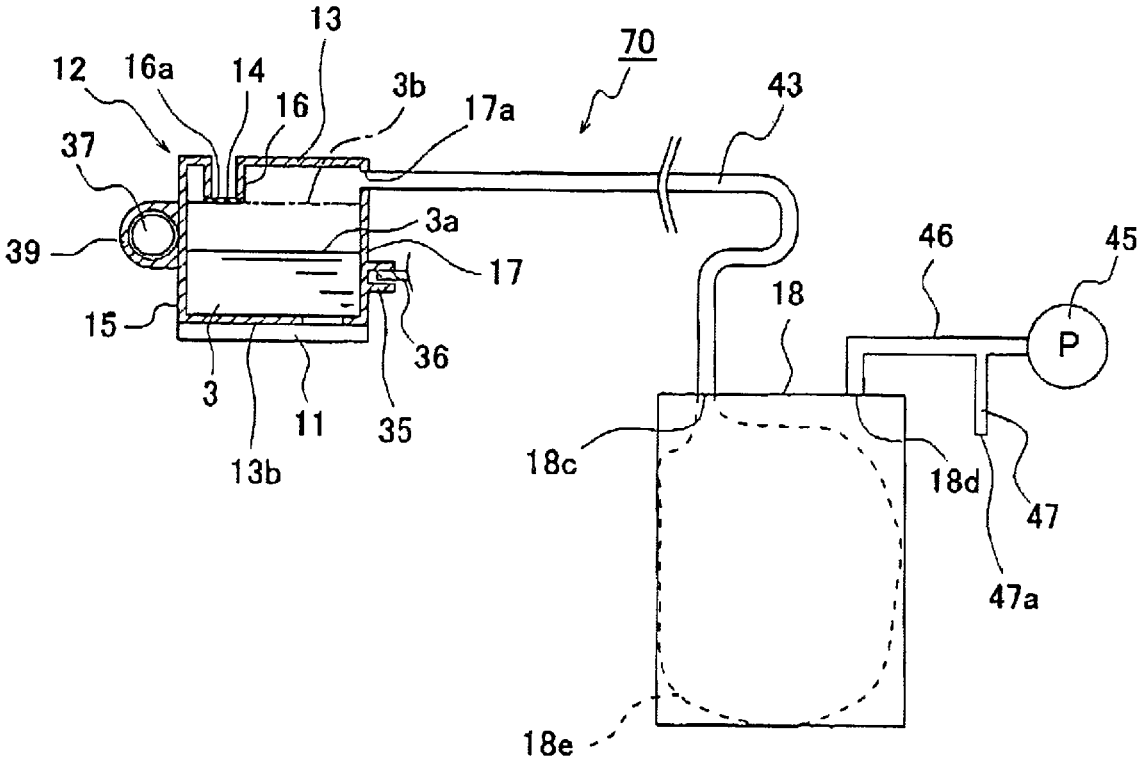
FIG. 5 is a partial cross sectional view showing a structure of an ink supply unit according to a third embodiment.

Referring to FIG. 5, an ink supply unit 70 includes the sub-tank 12, the main tank 18, and a pump 45. The sub-tank 12 is the same components of the ink supply unit 50 in the first embodiment, and, therefore, not repeatedly described here. The following merely explains the difference of the ink supply unit 70 of the present embodiment from the ink supply unit 50 of the first embodiment. The difference is that the ink supply unit 70 does not have the piston cylinder device 20 unlike the ink supply unit 50, but alternatively has the pump 45 provided separately from the main tank 18.

The main tank 18 of the ink supply unit 70, shown in FIG. 5, is provided with a flexible film 18*e*. The flexible film 18*e* uniformly transmits the pressure of compressed air from the pump 45 to the ink 3.

The main tank 18 is further provided with a hole 18*d*. One end of a fourth pipe 46 is connected to the main tank 18 via the hole 18*d*. The pump 45 is connected to another end of the fourth pipe 46. The pump 45 is operated by a drive device (not shown) provided in the main body of the printer 100. The pump 45 sends compressed air into the main tank 18 through the fourth pipe 46.

When the pump 45 is operated, the ink 3 stored inside of the main tank 18 is pressed via the flexible film 18*e*, and conveyed to the sub-tank 12 from a hole 18*c* through the third pipe 43 connecting the sub-tank 12 and the main tank 18.

The fourth pipe 46 is provided with a branch pipe 47 between the sub-tank 18 and the pump 45. A valving element 47*a* is provided on the leading portion of the branch pipe 47. When the pressure inside of the main tank 18 goes up to or higher than a predetermined pressure, compressed air from the pump 45 is released into outside air through the valving element 47*a*. Consequently, the sub-tank 12 is not imposed on pressure higher than the predetermined pressure.

[Operation of Ink Supply Unit 70]

When the power of the printer 100 is turned on by a user, firstly, the pump 45, shown in FIG. 5, is operated and sends compressed air into the main tank 18. The compressed air, sent into the main tank 18, presses the flexible film 18*e*. The ink 3 stored in the main tank 18 is conveyed into the third pipe 43.

As the ink 3, imposed pressure by the pump 45, is conveyed into the sub-tank 12 through the third pipe 43, air inside of the sub-tank 12 is discharged outside of the sub-tank 12 from the air-communication hole 16 through the air-permeable film 14.

When the ink surface 3*a* becomes in contact with the air-permeable film 14, the discharge of the air inside of the sub-tank 12 is stopped because the ink 3 blocks the fine holes of the air-permeable film 14.

As a result, the pressure inside of the sub-tank 12 increases. When the pressure inside of the sub-tank 12 becomes equal to or higher than the predetermined pressure, the pressure inside of the main tank 18, connected to the sub-tank 12 by the third pipe 43, also becomes or higher than the predetermined pressure. The compressed air from the pump 45 is released into the outside air from the valving element 47*a* provided at the leading portion of the branch pipe 47. Consequently, supply of the ink 3 from the main tank 18 to the sub-tank 12 is stopped.

The ink 3 inside of the sub-tank 12 is supplied to the recording head 11 and used for image formation onto a recording medium. When, for example, the ink 3 is used for image formation onto several sheets of paper, and the amount of the ink 3 inside of the sub-tank 12 decreases, the pump 45 is operated at a suitable timing. Once again, compressed air is sent into the main tank 18 and presses the flexible film 18*e*. The ink 3 stored in the main tank 18 is conveyed through the third pipe 43 to the sub-tank 12.

In accordance with this operation, the amount of the ink 3 inside of the sub-tank 12 can be maintained at a specific amount. Therefore, a specific amount of ink 3 can be supplied to the recording head 11. If the air-permeable film 14, which closes the air communication hole 16 inside of the sub-tank 12, is disposed as closely as possible to the top board 13, the ink 3 can be supplied to the sub-tank 12 up to almost full capacity of the sub-tank 12.

Fourth Embodiment

[Structure of Ink Supply Unit 80]

Figure 6A:
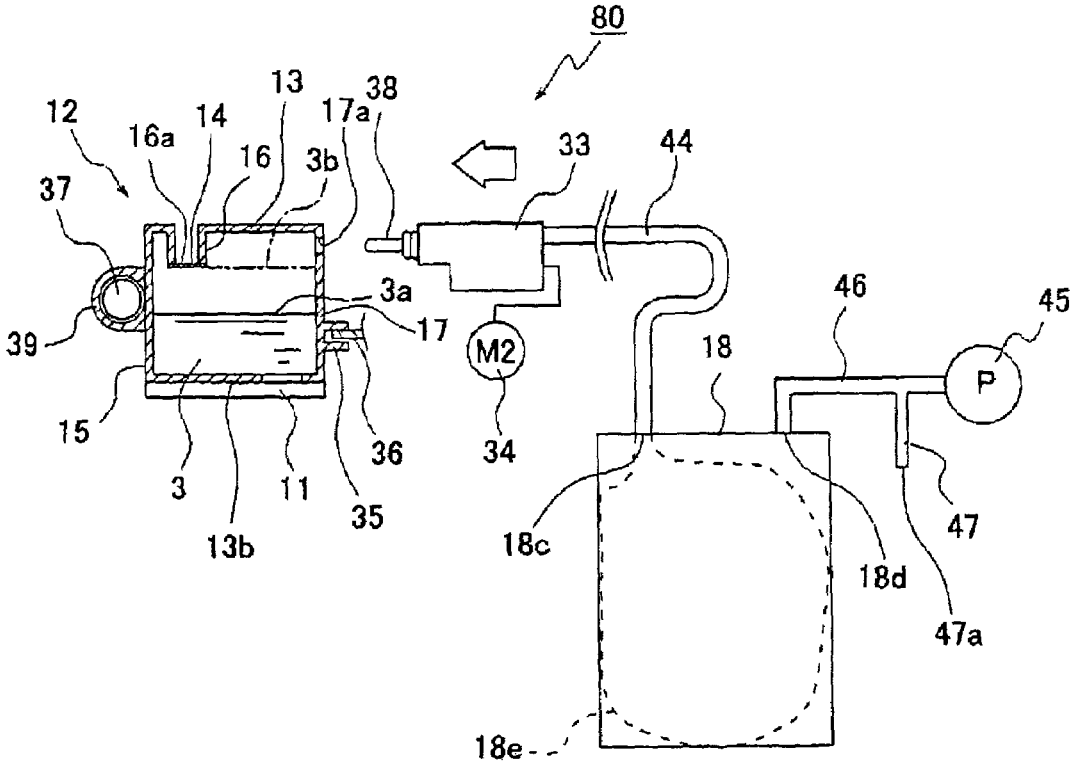
FIGS. 6A and 6B are partial cross sectional views showing structures of an ink supply unit according to a fourth embodiment.
Figure 6B:
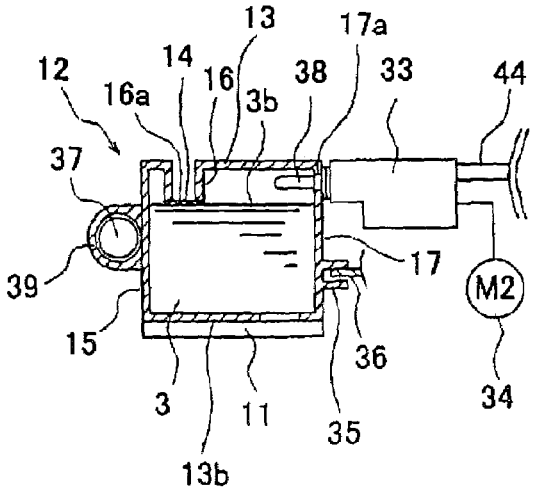

Referring now to FIGS. 6A and 6B, an ink supply unit 80 includes the sub-tank 12, the main tank 18, a third pipe 44, and a connector 33. The sub-tank 12 is the same component as in the ink supply unit 60 according to the second embodiment. The main tank 18 is the same component as in the ink supply unit 70 according to the third embodiment. Therefore, details of these tanks are not repeatedly described here.

The following merely explains the difference of the ink supply unit 80 according to the present embodiment from the ink supply unit 70 according to the third embodiment. The difference is that the third pipe 44, which connects the main tank 18 and the sub-tank 12, is formed to be attachable/detachable with respect to the sub-tank 12.

The third pipe 44, shown in FIGS. 6A and 6B, is provided with the connector 33 on the side of the sub-tank 12. The leading portion 38 is formed on the end of the connector 33 in the side of the sub-tank 12. The leading portion 38 is formed in a cylindrical shape, and can be inserted into the hole 17*a* formed on the side wall 17 of the sub-tank 12.

In a side view of the sub-tank 12, the hole 17*a* is disposed higher than the air-permeable film 14. When the leading portion 38 is disconnected from the hole 17*a*, the ink 3 inside of the sub-tank 12 does not spill outside of the sub-tank 12 through the hole 17*a*. Therefore, a check valve does not need to be provided in order to prevent the ink 3 from leaking outside of the sub-tank 12 from the hole 17*a*.

The pipe drive motor 34 is connected to the connector 33. The pipe drive motor 34 moves the connector 33 the third pipe 44 in the front-and-rear direction of the printer 100 (in the left-to-right direction in FIGS. 6A and 6B). The other end of the third pipe 44 in the side of the main tank 18 is configured in the same manner as in the third embodiment, and, therefore, not repeatedly described here.

[Operation of Ink Supply Unit 80]

When the power of the printer 100 is turned on by a user, firstly, the sub-tank 12 is moved by the carriage 51 to an ink supply position (not shown). Then, the pipe drive motor 34, shown in FIGS. 6A and 6B, is driven. The connector 33 of the third pipe 44 is moved to the front side of the printer 100 (in the left direction in FIG. 6B) by the pipe drive motor 34. The leading portion 38 is inserted into the hole 17*a* provided on the side wall 17 of the sub-tank 12.

Consequently, the pipe drive motor 34 is driven while the leading portion 38 is inserted into the hole 17*a*. The ink 3 is conveyed into the sub-tank 12 in the same manner as in the third embodiment. When the ink surface 3*b* inside of the sub-tank 12 becomes in contact with the air-permeable film 14 and the supply of the ink 3 from the main tank 18 to the sub-tank 12 is stopped in the same manner as in the third embodiment, the connector 33 of the third pipe 44 is removed from the hole 17*a* on the side wall 17 of the sub-tank 12 and moved to the rear side of the printer 100 as shown in FIG. 6A.

The ink 3 inside of the sub-tank 12 is supplied to the recording head 11 and used for image formation onto a recording medium. When, for example, the ink 3 is used for image formation onto several sheets of paper, and the amount of the ink 3 inside of the sub-tank 12 decreases, the pipe drive motor 34 is operated at a suitable timing. As shown in FIG. 6B, the connector 33 of the third pipe 44 is moved by the pipe drive motor 34 to the front side of the printer 100 (in the left direction in FIG. 6B). The leading portion 38 is inserted into the hole 17*a* provided on the side wall 17 of the sub-tank 12. Then, the ink 3 inside of the main tank 18 is once again pressed by the compressed air sent by the pump 45, and conveyed to the sub-tank 12 through the third pipe 44.

Due to the above-described operation, the amount of the ink 3 inside of the sub-tank 12 in the ink supply unit 80 according to the present embodiment can be maintained at a specific amount as well as in the ink supply unit 70 according to the third embodiment. In addition, the third pipe 44 does not need to be moved in the left-to-right direction of the printer 100 when the recording head 11 including the sub-tank 12 is moved with the carriage 51 in the left-to-right direction of the printer 100. Therefore, the lifetime of the third pipe 44 can be enhanced.

The ink supply unit 80 shown in FIGS. 6A and 6B in accordance with the fourth embodiment is configured in a manner so that the connector 33 of the third pipe 44 becomes in contact with the sub-tank 12 from the orthogonal direction with respect to the moving direction of the sub-tank 12 (a direction perpendicular to the sheet surface of FIGS. 6A and 6B), and the leading portion 38 is inserted into the hole 17*a* of the sub-tank 12. Alternatively, the connector 33 of the third pipe 44 can be in contact with the sub-tank 12 from the same direction as the moving direction of the sub-tank 12 (in a direction perpendicular to the sheet surface of FIGS. 6A and 6B). The leading portion 38 can be inserted into the hole 17*a* which is, in this case, provided on a side wall of the sub-tank 12 facing the moving direction of the sub-tank 12. In this configuration, the pipe drive motor 34, which drives the third pipe 44, is not needed.

In any of the above-described ink supply units 50 to 80 according to the first to fourth embodiments, the ink 3 inside of the sub-tank 12 can be maintained at a specific amount. The ink 3 can be supplied into the sub-tank 12 up to almost full capacity of the sub-tank 12 by disposing the opening 16*a* of the air communication hole 16 as closely as possible to the top board 13 of the sub-tank 12. As a result, short image recording can be completed with the ink 3 inside of the sub-tank 12. In case of long image recording, the number of ink supply into the sub-tank 12 during image recording can be reduced. Operation time until image formation is completed can be shorten. Therefore, image formation can be operated effectively.

If the amount of the ink 3 inside of the sub-tank 12 is at a specific amount, inertia of the sub-tank 12 when the sub-tank 12 is moved with the carriage 51 is constant. Therefore, the quality of image formation can be improved.

If the capacity of the cylinder 22 of the piston cylinder device 20 is larger than the capacity of the sub-tank 12, the sub-tank 12 can be filled with the ink 3 to the full capacity thereof only by one reciprocate movement of the piston 24 in the front-to-rear direction of the printer 100.

The present invention is not limited to the above-described embodiments. Variations and modifications are possible without departing from the technical idea of the present invention.

For example, the sub-tank 12 and the main tank 18 in the first to the fourth embodiments are almost in the rectangular parallelepiped shapes. The shapes of these tanks can be cubical shapes or other shapes according to need.

In a case wherein the printer 100 performs image recording with plurality of colors of ink, the printer 100 can be provided with one pressure supply mechanism having one excess pressure dispersion unit (the first pipe 26 (27) and the second pipe 28, or the valving element 47*a*) for each color of ink. The pressure supply mechanisms for necessary numbers of colors of ink can be operated by respective excess pressure dispersion units.

Furthermore, in the third and the fourth embodiments, compressed air is generated by the operation of the pump 45. The pump 45 can be operated by a motor (not shown) for the printer 100, or can be operated manually. As a result, the structure of the pressure supply mechanism can be more simplified.

Still furthermore, the present invention can be applied not only to an inkjet recording apparatus as described above, but also to, for example, a soldering apparatus which ejects melting solder and automatically performs soldering onto various printed-wiring boards. The present invention can be also applied to an apparatus which ejects polymeric organic material (illuminant) in an inkjet manner and forms an organic film. The present invention can be also applied to various liquid droplet jet devices which eject droplets of liquid stored in a sub-tank from nozzles, such as an apparatus wherein resin is slurried and ejected from nozzles.

What is claimed is:

1. A liquid supply unit comprising:

a main tank that stores liquid;

a sub-tank provided in a jet device that ejects liquid droplets and connected to the main tank;

a pressure supply mechanism that applies predetermined pressure to the liquid reserved in the main tank and supplies the liquid in the main tank to the sub-tank;

an air communication hole that is provided on an upper surface of the sub-tank and communicates inside of the sub-tank with atmospheric air;

an air-permeable film provided so as to close the air communication hole, the air-permeable film being capable of passing air but not capable of passing liquid; and an excess pressure dispersion unit that disperses excess pressure from the liquid supply unit when the liquid inside of the sub-tank becomes in contact with the air-permeable film and pressure inside the sub-tank becomes equal to or higher than predetermined pressure.

2. The liquid supply unit as set forth in claim 1, wherein the pressure supply mechanism comprising:

a cylinder provided in a liquid supply path for supplying the liquid from the main tank to the sub-tank, and connected with the sub-tank by a first pipe and with the main tank by a second pipe;

a piston that is slidably disposed inside of the cylinder, and capable of applying pressure to the liquid inside of the cylinder, and wherein the excess pressure dispersion unit comprising:

the first pipe; and the second pipe having a smaller inner diameter than an inner diameter of the first pipe.

3. The liquid supply unit as set forth in claim 2 wherein the first pipe is attachable/detachable with respect to the sub-tank.

4. An inkjet recording apparatus comprising the liquid supply unit as set forth in claim 2.

5. The liquid supply unit as set forth in claim 1, wherein the pressure supply mechanism comprises an air pressure pump that is disposed in an upstream side of a liquid supply path for supplying liquid from the main tank to the sub-tank as compared to the main tank, pressurizes air, and supplies the pressurized air into the main tank so as to convey liquid inside of the main tank into the sub-tank, and wherein the excess pressure dispersion unit comprises a valving element that is disposed on a pipe connecting the air pressure pump and the main tank, and releases excess pressure into atmospheric air when pressure inside of the pipe goes up beyond the predetermined pressure.

6. The liquid supply unit as set forth in claim 5 wherein the pipe connecting the main tank and the sub-tank is attachable/detachable with respect to the sub-tank.

7. An inkjet recording apparatus comprising the liquid supply unit as set forth in claim 5.

8. An inkjet recording apparatus comprising the liquid supply unit as set forth in claim 1.

* * * * *